US007438185B2

(12) United States Patent
Ho et al.

(10) Patent No.: US 7,438,185 B2
(45) Date of Patent: Oct. 21, 2008

(54) STACKABLE TRAY WITH INTEGRAL LATCH

(75) Inventors: Thi Q. Ho, Murrieta, CA (US); David M. Christensen, Fallbrook, CA (US)

(73) Assignee: Peak Plastic and Metal Products (International) Limited, Hong Kong (HK)

( * ) Notice: Subject to any disclaimer, the term of this patent is extended or adjusted under 35 U.S.C. 154(b) by 604 days.

(21) Appl. No.: 11/130,722

(22) Filed: May 17, 2005

(65) Prior Publication Data

US 2006/0260970 A1 Nov. 23, 2006

(51) Int. Cl.
*B65D 21/00* (2006.01)
*B65D 85/62* (2006.01)

(52) U.S. Cl. ..... 206/509

(58) Field of Classification Search ..... 220/23.4; 206/504, 509, 511

See application file for complete search history.

(56) References Cited

U.S. PATENT DOCUMENTS 4,212,415 A * 7/1980 Neely ..... 222/231
4,457,432 A 7/1984 Solheim ..... 206/503
4,619,363 A * 10/1986 Wolfseder ..... 206/373
5,184,726 A * 2/1993 Box ..... 206/509
5,190,156 A * 3/1993 Conaway et al. ..... 206/509
5,344,022 A 9/1994 Stahl ..... 206/507
5,421,455 A 6/1995 Clatanoff et al. ..... 206/328
5,544,751 A * 8/1996 Klodt et al. ..... 206/509
5,577,613 A 11/1996 Laidlaw ..... 206/510
2005/0249651 A1 * 11/2005 Riley ..... 422/300

* cited by examiner

*Primary Examiner*—Anthony D Stashick
*Assistant Examiner*—Harry A Grosso
(74) *Attorney, Agent, or Firm*—Isabelle R. McAndrews

(57) ABSTRACT

The invention concerns a tray having an integral latch that mates to a boss of an adjacent tray to form a stable stack. The latch may be incorporated into any type of tray, basket, or other container for storing articles. Multiple containers may be stacked together without the use of a detachable clip. Also disclosed is a tray that includes an array of posts extending downward to support the tray on a flat surface.

19 Claims, 7 Drawing Sheets

STACKABLE TRAY WITH INTEGRAL LATCH

BACKGROUND OF THE INVENTION

FIG. 1A illustrates a conventional tray 100 for transporting disk drive components. Tray 100 can be assembled into a stack by attaching a clip onto protrusion 20 and lip 13. Such a clip 15 is shown in FIG. 1B. To properly secure the stack 30 of FIG. 1B, it is necessary to attach clip 15 to both sides of the stack. The disadvantages of a separate clip is that it can be easily misplaced and it has a limited stacking capacity. Only four trays can be secured in a stack with the prior art clip 15. Clip 15 has a fixed height. Consequently, the number of trays that can be secured in a stack is always limited to the parameters of clip 15. A need therefore exists for securing a stack of trays without having to use detachable clips.

SUMMARY OF THE INVENTION

The invention pertains to a tray having an integral latch for securing multiple trays in a stack. The latch is molded into the tray and permits multiple trays to mate together without using a separate detachable clip.

The present invention also pertains to a method of stacking two or more trays. In this embodiment, a first tray is aligned to the top of a second tray and the latch from one tray is moved toward the boss of the second tray. Thereafter the first tray is secured to the second tray by interlocking the latches of a first tray to bosses of a second tray.

DETAILED DESCRIPTION OF THE INVENTION

Figure 1A:
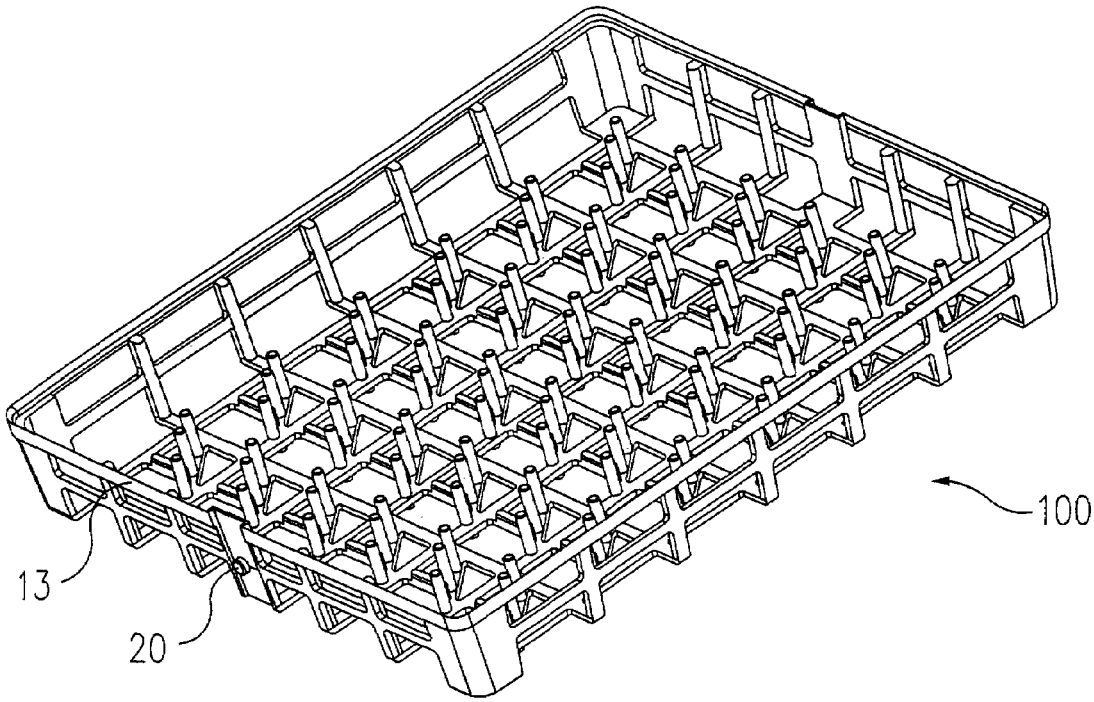
FIG. 1A (PRIOR ART)
FIG. 1A illustrates a tray with a boss for attachment to a clip in accordance with the prior art.
Figure 1B:
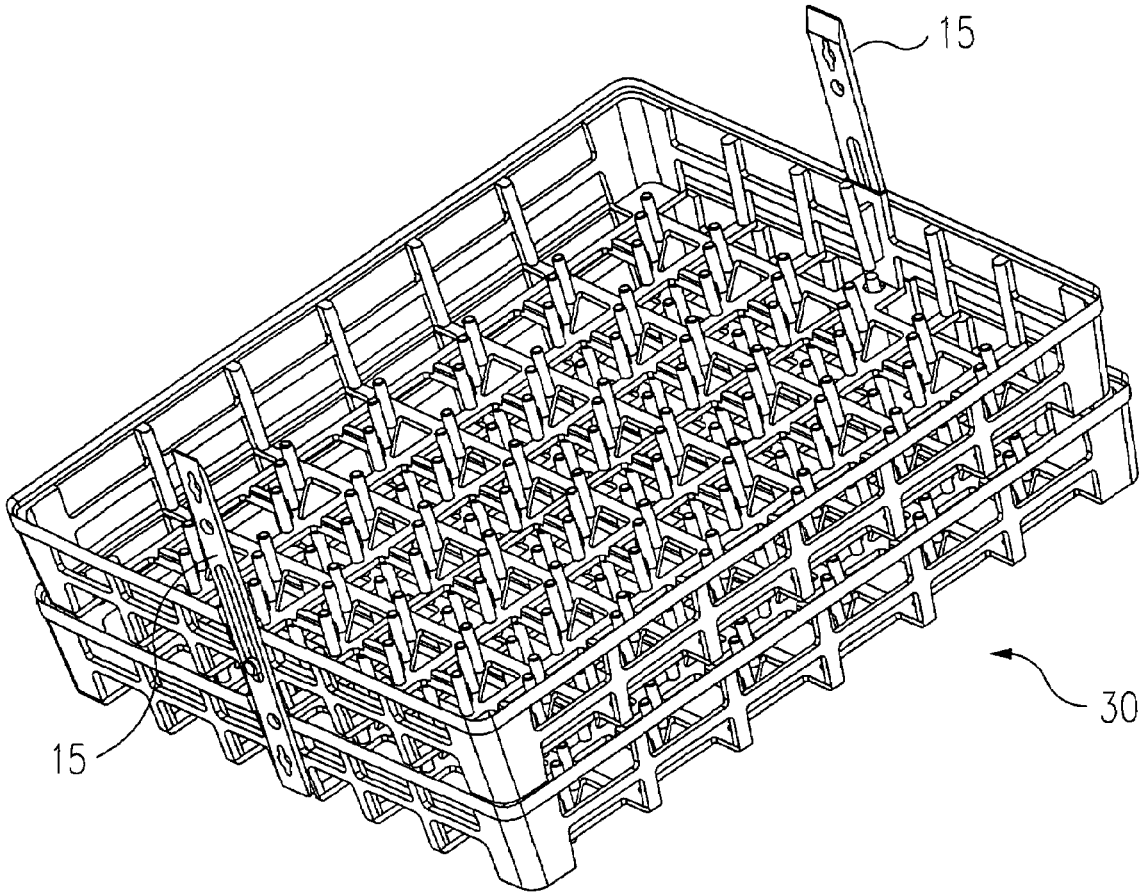
FIG. 1B (PRIOR ART)
FIG. 1B illustrates a stack of trays secured with a clip in accordance with the prior art.

The preferred embodiments of the present invention will now be described with reference to FIGS. 2A-5B. Similar components are designated with the same reference numerals throughout the various figures. The specific details and parameters are provided herein to further the understanding of the invention.

Figure 2A:
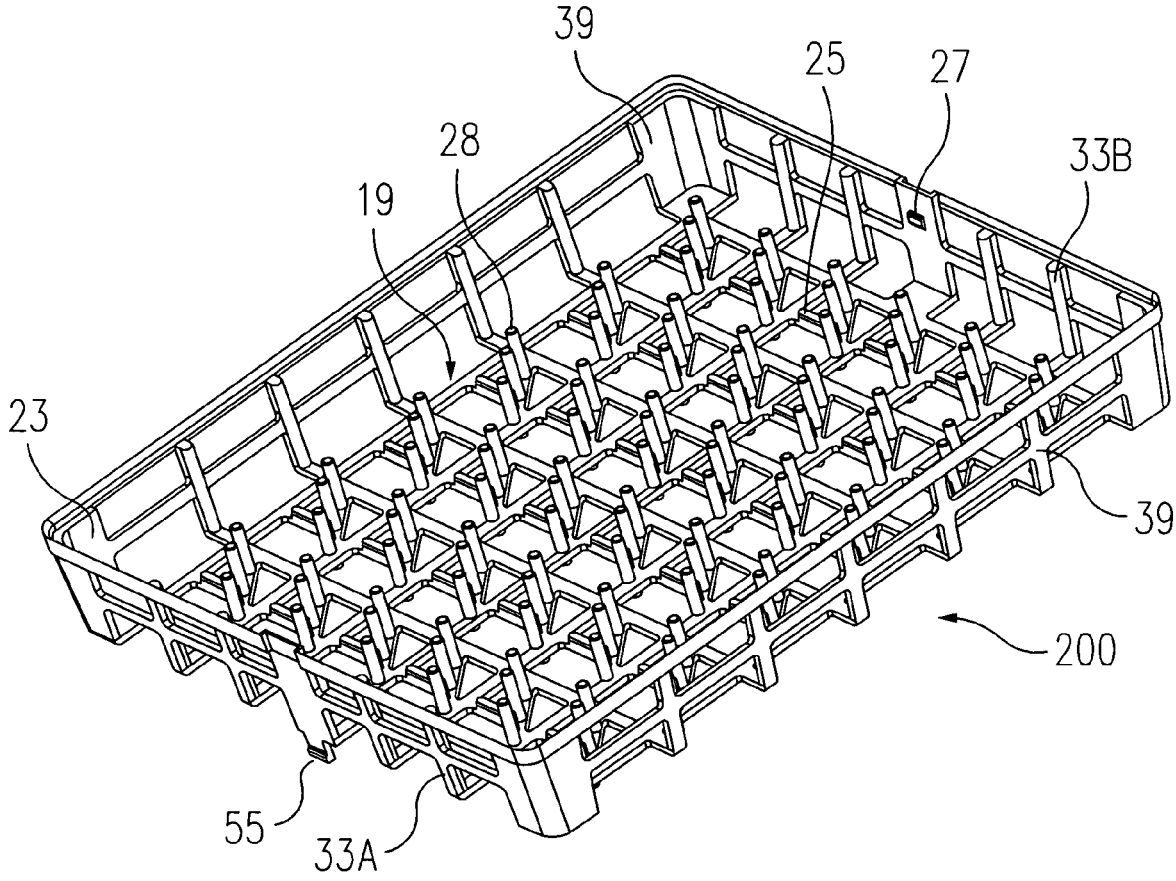
FIG. 2A illustrates a perspective view of a tray having an integral latch in accordance with the invention.

A tray 200 in accordance with the invention is illustrated in FIG. 2A as including an integral latch 55. Tray 200 preferably has a basket or box-like configuration that includes a base 25 and a wall structure 23 extending from the base at a predetermined draft angle. Wall structure 23 comprises a first and a second pair of walls 37, 39. An axis of symmetry exists between each pair of walls. Consequently, each of the second pair of walls has identical structures as the other. In the embodiment of FIG. 2A, boss 27 is shown on one surface of wall 37, whereas latch 55 extends from a first pair of walls. In the embodiment of FIG. 2A, latch 55 extends from the exterior of each wall 37.

Figure 2B:
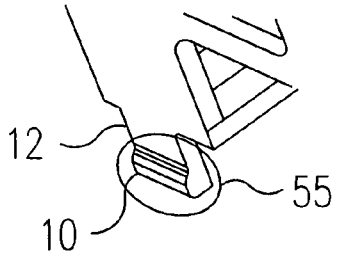
FIG. 2B illustrates an exploded view of the latch head.
Figure 2C:
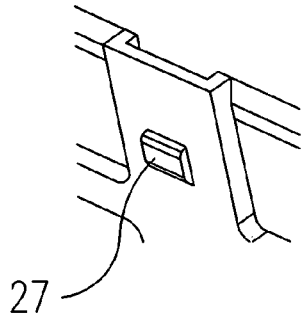
FIG. 2C illustrates an exploded view of the boss portion of the latch.

FIG. 2B illustrates an enlarged view of latch 55, which comprises a head 10 connected to an extension 12. Tray 200 and latch 55 are molded from the same material. However, latch 55 is more flexible than the other portions of tray 200 because the snap side of the latch is unconstrained. In addition, latch 55 preferably curves slightly outward in one direction. FIG. 2C illustrates an enlarged view of boss 27, facing inward, toward the storage area of the tray.

Figure 3:
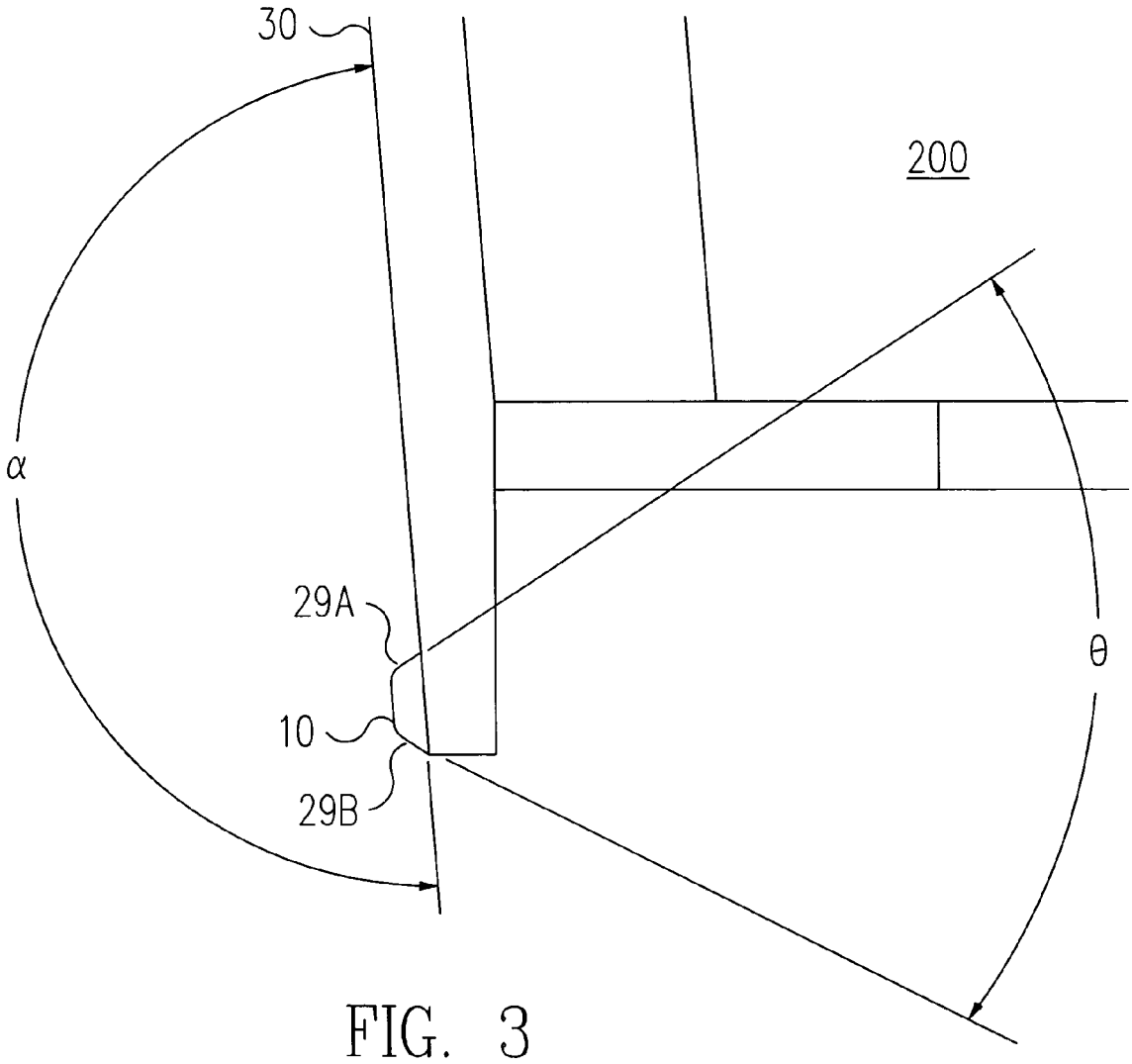
FIG. 3 illustrates the principal angles associated with the latch.

The principal angles associated with the integral latch are illustrated in FIG. 3. Latch head 10 is defined by edges 29A and 29B. Edges 29A and 29B are angled to facilitate mating with a second tray. In a preferred embodiment, the angle $\theta$ between edge 29A and edge 29B ranges from 30 to 60 degrees. In this embodiment, the latch comprises a cantilever snap that projects outward from tray 200. The cantilever snap is preferably present on each of a first pair of walls (such as walls 33A and 33B). Cantilever snap is also coplanar with the exterior surfaces of walls 33A and 33B. The preferred draft angle $\alpha$ between wall surface 30 and the latch head 10 ranges from 178 degrees and 180 degrees as shown in FIG. 3.

Figure 4A:
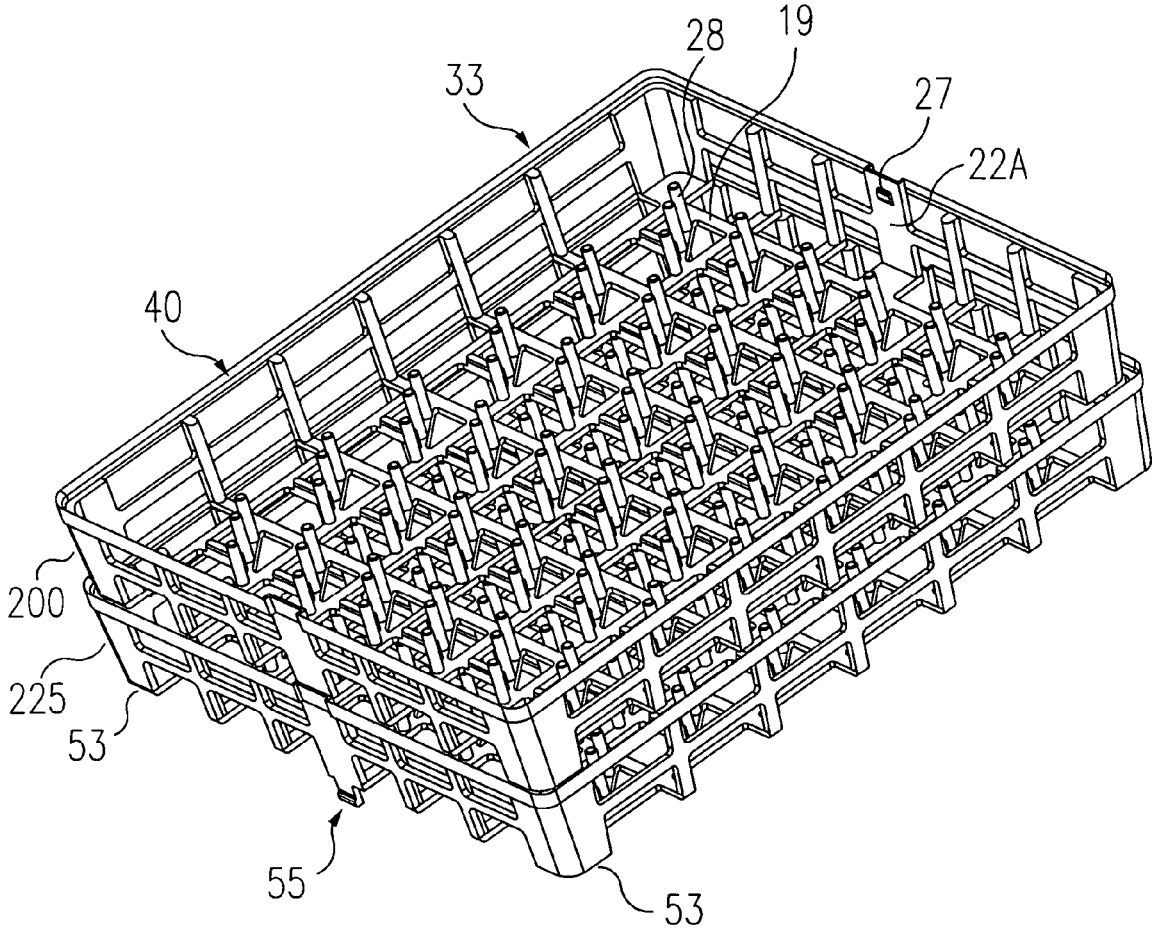
FIG. 4A is a sectional view of the tray stack illustrates a stack assembled in accordance with the present invention.
Figure 4B:
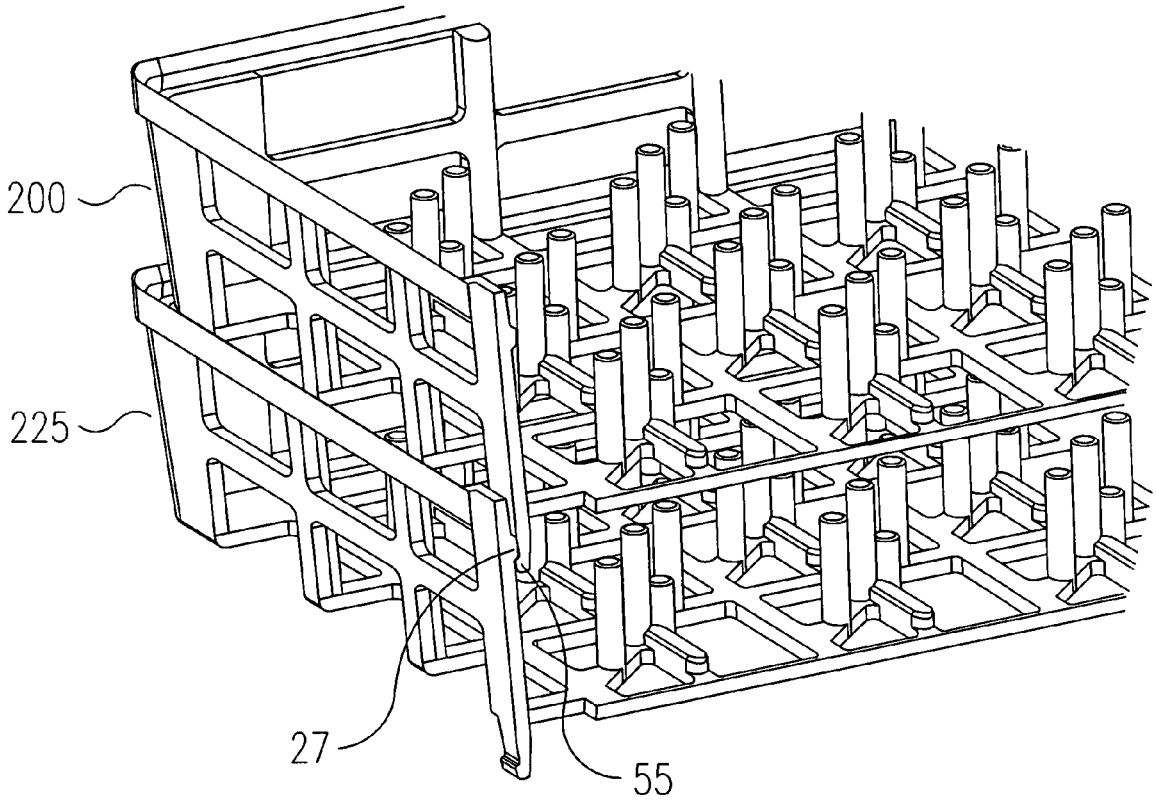
FIG. 4B is a sectional view of the tray stack of FIG. 4A.

FIGS. 4A and 4B illustrate trays 200 and 225 in a tray assembly are designed to stack on top of each other. The perimeter of tops 33 and corner regions 53 have profiles that facilitate stacking. Each tray has a lip 40 on the perimeter that may support corner regions 53 of an adjacent tray when stacked together. Specifically, a lower portion of each corner region may be supported by a lip 40 of an adjacent tray in a stack of trays. Bosses 27 of tray 200 are shown in FIG. 4A on interior wall 22A. In operation each latch 55 grips a boss of an adjacent tray to snap the trays together. When trays 200 and 225 are snapped together, it is not possible to simply lift tray 200 vertically away from 225 without applying a force.

To disassemble the stack of FIG. 4B, an operator places one hand on tray 225 and exerts a pull force by gripping a portion of tray 200 with a second hand. In this manner, the pull force separates latches 55 of tray 200 from bosses 27 of tray 225. FIG. 4B illustrates a sectional view of boss 27 snapped into latch 55. In the most preferred embodiment, latch 55 is provided on a lower portion of each tray, and the boss is located on an interior upper wall surface. However, the location of the boss and the latch can be interchanged. In other words, in a less preferred embodiment, the latch may extend from an upper interior portion of the tray, and the boss can protrude from a lower exterior wall portion.

Figure 5A:
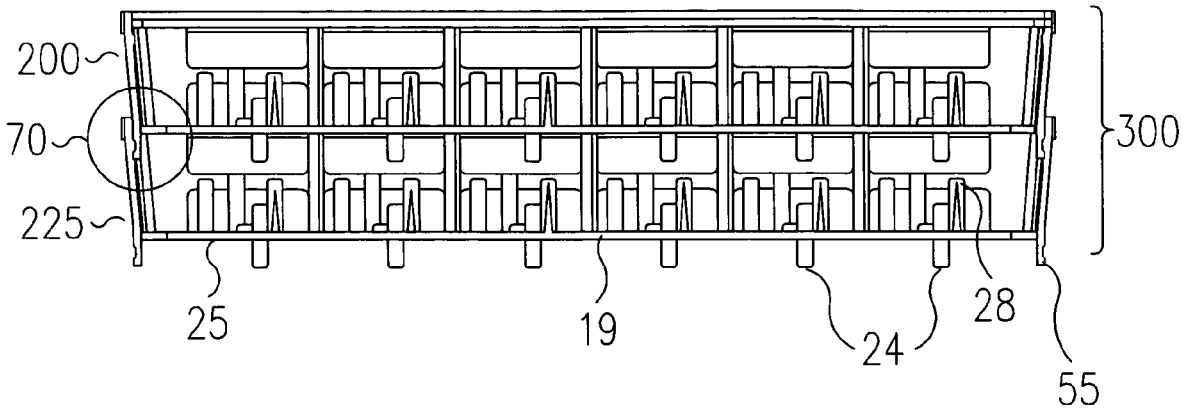
FIG. 5A illustrates a stack assembled in accordance with a second embodiment of the present invention.
Figure 5B:
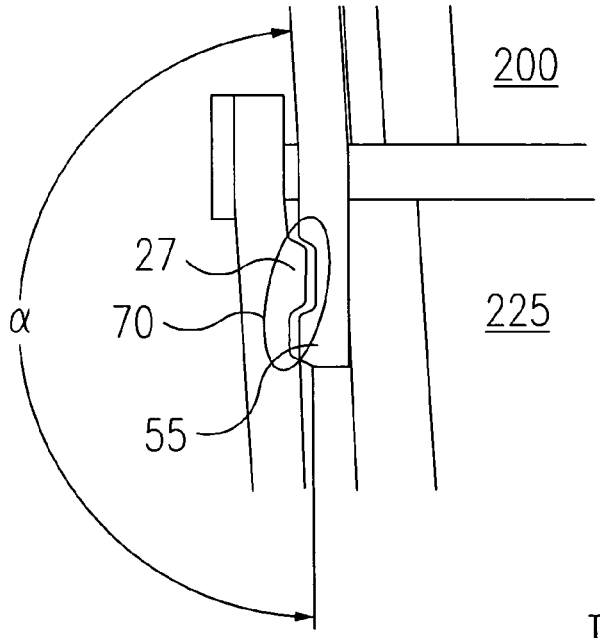
FIG. 5B is a sectional view of the tray stack of FIG. 5A.

Tray 200 of FIG. 4A has a base that includes posts 28 extending perpendicular to the floor 19. Ramps are retained between posts 28. In addition, tray 200 has a plurality of openings on each pair of walls and on the base. Alternative embodiments of the invention encompass trays that have a different floor on the base. FIG. 5A illustrates a sectional view of an alternative tray assembly wherein the base includes posts 24 extending downward from floor 19. Posts 24 allow any tray or tray assembly of the present invention to be placed on a flat surface. In this embodiment, latch 55 preferably is shorter than post 24. Otherwise, tray assembly 300 will rock if the length of latch 55 exceeds the length of posts 24. FIG. 5A also illustrates the interference fit 70 that results when trays 200 and 225 are interlocked together. An exploded view of the interference fit 70 is shown in FIG. 5B. When $\alpha$ is 178°, the interference or overlap in section 70 is 0.20 mm. The interference decreases to 0.10 mm, when $\alpha$ is 180°.

The present invention is not limited to solely containers that include posts 28 or 24, or both 28 and 24. For example, the floor of base 25 may instead include slots, pockets, raised mounts, or any other configuration for transporting articles. Moreover, the floor may alternatively be planar. Yet another example of a tray which may include the latch of the present invention is described in the following U.S. application entitled "Retention Latch for Packaging Apparatus" filed by the same inventors on May 16, 2005, the disclosure of which is hereby incorporated by reference. It is also understood that the invention may be used in baskets, and other containers in addition to trays, that are suitable for handling a plurality of articles.

The types of components that can be stored in trays 200 include electronic devices, medical instruments, and other articles of manufacture.

An advantage of the present invention is that the number of trays that can be stacked is not limited to the parameters of a detachable clip. The present invention relies on a latch and boss that are molded into the trays. When it is desirable to assemble a group of trays together, each tray is easily connected into a stable stack by mating their respective bosses to the latches of an adjacent tray.

What is claimed:

1. A tray assembly comprising:

a) a base that includes a floor having at least one horizontal planar section;

b) a wall structure extending upward from the base comprising a first and a second pair of walls, each of said walls having substantially the same height;

c) a boss on each of the first pair of walls;

d) a latch extending from each of the first pair of walls, wherein said latch comprises an extension that is coplanar with an exterior surface of said first pair of walls, wherein said extension has a latch head on one end that grips the boss of an adjacent tray to form a tray assembly for storing a plurality of articles; and e) the tray assembly being formed by a first tray nesting partially within a second tray when the latch and boss mate together, such that the horizontal planar section of the first tray is below an upper edge of the second tray.

2. The tray assembly of claim 1, wherein the latch comprises a cantilever snap that grips only an outer surface of the boss.

3. The tray assembly of claim 1, wherein the latch projects outward, in a direction away from a storage area formed by the wall structure and base.

4. The tray assembly of claim 3, wherein the boss is located entirely on at least one of the interior surfaces and faces a boss on a second wall of the first pair of walls.

5. The tray assembly of claim 1 wherein a portion of the array of posts are located below the plane of the base to enable the tray assembly to be placed on a flat surface.

6. The tray assembly of claim 1 further comprising a plurality of openings on each wall and on the base.

7. The tray assembly of claim 1 further comprising a lip on a perimeter of the tray, and corner regions that are solid.

8. The tray assembly of claim 7 wherein a lower portion of each corner region is supported by the lip of an adjacent tray in a stack of trays.

9. The tray assembly of claim 1, wherein said latch head comprises an upper edge and a lower edge, and wherein the upper and lower edge are separated by an acute angle.

10. A tray assembly comprising at least two trays, each tray including:

a) a base;

b) a wall structure comprising two end walls and two side walls extending from the base, each of said walls having substantially the same height, and having an interior side facing a storage area, and an exterior side opposite the interior side;

c) a boss on at least one interior side of said end walls;

d) a latch on a first tray, wherein the latch projects outward, away from the storage area of a first of said trays, and wherein each latch includes a cantilevered member that occupies part of the storage area of a second tray that is beneath the first tray when the latch grips the boss of the second tray to form a tray assembly.

11. The tray assembly of claim 10, wherein each latch is provided on the exterior side of each end wall and wherein one of said latches grips only an exterior surface of one of said bosses.

12. The tray assembly of claim 10, wherein said latch comprises an extension that is coplanar with an exterior surface of said end walls, and wherein said extension has a latch head on one end.

13. The tray assembly of claim 10, wherein each boss is a unitary structure.

14. The tray assembly of claim 10, wherein each boss is located entirely on a single wall of each tray.

15. The tray assembly of claim 10, wherein the latch is located near an upper edge of each tray when the boss is located near the base of each tray.

16. The tray assembly of claim 10, wherein said latch head comprises an upper edge and a lower edge, said upper and lower edges being separated by an angle between 30° and 60°.

17. A method of stacking two or more trays comprising:

a) providing a plurality of trays having a base, and a wall structure extending upward from the base comprising a first and a second pair of walls;

b) providing a storage area surrounded by an interior surface of said wall structure having a boss located on said interior surface;

c) providing a latch located on an exterior surface of the wall structure, said latch including a cantilevered member; and d) aligning a first one of said trays on top of a second one of said trays, by pushing the first tray against the second tray until the latch and the boss snap into an interlocked position and the first tray becomes partially nested within the second tray, such that the cantilevered member of the latch of the first one of said trays is located within the storage area of the second tray.

18. The method of claim 17, wherein the latch and the boss make contact at only their respective exterior surfaces to thereby snap into an interlocked position.

19. The method of claim 17, wherein said latch has an extension that is coplanar with an exterior surface of said first pair of walls.

* * * * *